United States Patent [19]

Wada et al.

[11] Patent Number: 4,780,741

[45] Date of Patent: Oct. 25, 1988

[54] METHOD AND APPARATUS FOR FORMING TONER LAYER

[75] Inventors: Takasumi Wada; Susumu Shoji, both of Tokyo, Japan

[73] Assignee: Kyocera Corporation, Kyoto, Japan

[21] Appl. No.: 828,762

[22] Filed: Feb. 11, 1986

[30] Foreign Application Priority Data

| | | | |
|---|---|---|---|
| Feb. 19, 1985 | [JP] | Japan | 60-29339 |
| Feb. 19, 1985 | [JP] | Japan | 60-29340 |
| Apr. 16, 1985 | [JP] | Japan | 60-79342 |

[51] Int. Cl.[4] ..... G03G 15/08

[52] U.S. Cl. ..... 355/3 DD; 118/653

[58] Field of Search ..... 355/3 DD, 14 D, ; 430/122, 110; 118/656-658, 653

[56] References Cited

U.S. PATENT DOCUMENTS

| | | | |
|---|---|---|---|
| 3,667,728 | 6/1972 | Smith | 118/652 |
| 4,395,485 | 7/1983 | Kashiwagi et al. | 430/110 X |
| 4,406,535 | 9/1983 | Sakamoto et al. | 355/3 DD |
| 4,430,411 | 2/1984 | Tamura et al. | 118/657 X |
| 4,525,056 | 6/1985 | Itaya et al. | 355/3 DD |
| 4,564,285 | 1/1986 | Yasuda et al. | 355/3 DD |
| 4,575,220 | 3/1986 | Sakamoto et al. | 355/3 DD |
| 4,625,676 | 12/1986 | Sakamoto et al. | 118/657 |

OTHER PUBLICATIONS

*The American Heritage Dictionary,* Second College Edition, Houghton Mifflin Co., 1982, p. 705.

*Primary Examiner*—Arthur T. Grimley
*Assistant Examiner*—J. Pendegrass
*Attorney, Agent, or Firm*—Spensley Horn Jubas & Lubitz

[57] ABSTRACT

The invention relates to a method and apparatus for forming a toner layer adapted for electrophotographic developing apparatuses for developing using magnetic toner. Toner carried on a toner carrier and flowing toward the developing position is regulated in thickness by a toner layer thickness regulating member contacting the surface of the toner carrier. Lines of magnetic force are applied to the toner layer having a regulated thickness so as to stir the toner conveyed toward the developing position, thereby forming a uniform toner layer at the downstream side. The toner layer thickness regulating member can be a thin plate member of a nonmagnetic material having elasticity, or a rigid blade having a pivotal proximal end. The toner is stirred in a repulsive magnetic field forming region formed between a magnetic blade and the toner carrier.

3 Claims, 3 Drawing Sheets

METHOD AND APPARATUS FOR FORMING TONER LAYER

BACKGROUND OF THE INVENTION

1. Field of the Invention

The present invention relates to a method and apparatus for forming a toner layer, which are used in an electrophotographic developing apparatus for developing an image using magnetic toner.

2. Description of the Prior Art

In a conventional method of forming a toner layer used in electrophotographic developing apparatuses, a thin plate member called a Myler is brought into contact with a toner carrier which carries toner on its surface and conveys toner to the developing position. The thickness of the toner layer is regulated by the contact pressure. In another conventional method, a toner layer thickness regulating member called a doctor blade is arranged to oppose a toner carrier, and the thickness of the toner layer is regulated by a gap between the two members.

In the former method, since a toner layer is formed by the contact pressure, wave-like stripes tend to form in the toner layer surface. In order to prevent such stripes, a technique is disclosed in Japanese Patent Disclosure No. 54-137346, and the like. In this technique, the surface of a toner carrier has a three-dimensional pattern and its cross-section has a special profile. However, this technique cannot completely solve the above problem if the toner has poor flowability or toner particles agglomerate.

In the latter method, the thickness of a toner layer is regulated by cutting the toner layer by a doctor blade (to be referred to as ear trim hereinafter). A toner layer formed by this method normally has a thickness which is slightly larger than the gap between the two members. For this reason, a very small gap must be set between the two members. If such a very small gap must be set between the two members with high precision, assembly precision in mounting the doctor blade and machining precision thereof must be high.

In order to solve this problem, a toner layer forming apparatus as shown in FIG. 7 is disclosed in Japanese Patent Laid Open No. SHO 55-103567. In this apparatus, magnetic poles 103 are embedded in the circumferential surface of a fixed magnet assembly 102 enclosed in a toner carrier 101. A magnetic blade 104 is arranged at a position of the toner carrier 101 which opposes the magnetic poles 103. The magnetic blade 104 serves as a toner layer thickness regulating member. Lines of magnetic force Mg act on a gap between the blade 104 and the toner carrier 101.

Referring to FIG. 7, reference numeral 105 denotes a photosensitive drum opposing the toner carrier 101. The drum 105 is closest to the toner carrier 102 at the developing position which is at the downstream side of the mounting position of the blade 104. Reference numeral 106 denotes an AC power source for applying an AC electric field on the toner carrier 101.

According to this basic conventional technique, toner carried on the toner carrier 101 and conveyed toward the developing position is stirred and regulated in layer thickness in the gap between the two members by the lines of magnetic force Mg. Thus, a toner layer having a uniform and stable thickness can be formed at the developing position.

In this basic conventional technique, unlike the other conventional methods, the toner layer thickness is not regulated by the "ear trim" means. Instead, the lines of magnetic force Mg are applied to the toner layer to set a low tone particle density. In this state, the "ear trim" operation by the magnetic blade 104 is performed to regulate the thickness of the toner layer. Thereafter, the toner ears are rearranged or shaped at the outlet side of the gap, thereby forming a reason, the gap can be set to be larger than the desired thickness of the toner layer, specifically, 1.5 times or more. Thus, agglomeration or clogging of toner can be prevented. In addition, if the gap between the two members can be set to be larger than the desired thickness of the toner layer, the mounting precision of the magnetic blade 104 need not be very high. As a result, the problems encountered with the conventional techniques described above can be solved considerably.

In the basic conventional technique, however, since the basic operation involves simultaneous toner stirring and toner layer thickness regulation, the following problem is encountered.

In the basic conventional technique, even if the toner layer density is set low, layer thickness regulation called "ear trim" is still performed by a mechanical slide means i.e., the magnetic blade 104. Therefore, the thickness of the formed toner layer varies in accordance with variations in the gap size.

Although the precision in setting the gap and mounting the magnetic blade 104 is moderated when compared with other conventional apparatuses, a considerably high precision must still be set, resulting in cumbersome adjustment.

In a method of forming a toner layer by simultaneous toner stirring and toner layer thickness regulation, if the toner carrier 101 is rotated at high speed, toner may not be stirred sufficiently before a toner layer is formed. This may result in difficulty in forming a toner layer of uniform thickness.

In accordance with the conventional technique described above, toner tends to deposit on the upstream side wall of the magnetic blade 104. In addition, since the gap between the blade 104 and the carrier 101 is set to be larger than the desired thickness of a toner layer, the deposited toner may enter this gap or a portion downstream of the blade 104. Such entrance of toner may disturb the formed toner layer.

If the thickness of a toner layer is regulated by a mechanical sliding means such as the magnetic blade 104 described above, toner charge is increased by friction between the sliding surface of the blade 104 and the magnetic toner. This will cause variations in the thickness of the toner layer or adversely affect the toner charge characteristics. This also leads to separation of a flowability accelerator held on the toner surface, thereby causing poor flowability of the toner, changes over time in charge characteristics, and agglomeration of toner particles. This adversely affects sharpness of the developed image.

SUMMARY OF THE INVENTION

It is an object of the present invention to provide a method and apparatus for forming a toner layer, wherein toner layer thickness and toner stirring are not performed simultaneously but are performed with; a time difference, so that a toner layer without stripes or waving can be formed.

It is another object of the present invention to provide a method and apparatus for forming a toner layer, wherein a toner layer having a very small thickness can be formed.

It is still another object of the present invention to provide a method and apparatus for forming a toner layer, which can eliminate any stripes formed in a toner layer surface during toner layer thickness regulation, thereby forming a toner layer of uniform thickness.

It is still another object of the present invention to provide a method and apparatus for forming a toner layer, which allows setting of a gap between a toner carrier and a magnetic blade with a relatively low precision, thereby allowing easy assembly and machining.

It is still another object of the present invention to provide a method and apparatus for forming a toner layer, which can prevent deposition of toner on the upstream wall of the magnetic blade.

It is still another object of the present invention to provide a method and apparatus for forming a toner layer, which assures reliable toner stirring and toner layer thickness regulation even if the toner carrier is rotated at high speed, thereby forming a toner layer of uniform thickness.

It is still another object of the present invention to provide a method and apparatus for forming a toner layer, which can stir toner fast and sufficiently.

It is still another object of the present invention to provide a method and apparatus for forming a toner layer, which can prevent any entrance of floating or agglomerated toner until toner is stirred after the thickness of the toner layer is regulated.

It is still another object of the present invention to provide a method and apparatus for forming a toner layer, which absorb variations in contact pressure due to vibration of the toner carrier and the like and which allow formation of a toner layer of uniform thickness.

It is still another object of the present invention to provide a method and apparatus for forming a toner layer, which can form a toner layer of uniform thickness even if toner having poor flowability or agglomerated toner is used.

It is still another object of the present invention to provide a method and apparatus for forming a toner layer, which can form a toner layer of uniform and stable thickness without allowing a flowability accelerator on the toner surface to separate.

It is still another object of the present invention to provide a method and apparatus for forming a toner layer, which can prevent variations or instability in thickness of the toner layer, which are caused by poor flowability or charge characteristics of toner.

The above and other objects, features and advantages of the present invention will become apparent from the following description and the accompanying drawings.

According to an aspect of the present invention, there is provided a method of forming a toner layer, wherein after toner carried on a toner carrier and conveyed toward the developing position is subjected to regulation of the toner layer thickness, lines of magnetic force are applied to the toner layer to stir it Stirring of toner may be understood as follows. That is, magnetic force acting on the toner layer held on the toner carrier is released or decreased by the lines of magnetic force, thereby setting the toner density low or floating the toner on the carrier. The toner layer having a low particle density is rearranged in a downstream region at which it is not subjected to lines of magnetic force. As a result, a toner layer of uniform thickness can be formed.

As a preferred apparatus for practicing the present invention, there is provided an apparatus for forming a toner layer, wherein a toner layer thickness regulating means and a magnetic field forming means are arranged on a toner carrier at an upstream side of the developing position sequentially along the moving direction of the toner carrier. After the thickness of the toner layer is regulated and the toner is stirred in the magnetic field forming region, the layer reaches the developing position.

In the toner layer thickness regulating means, a free end of an elastic nonmagnetic thin plate or a free end of a rigid nonmagnetic thin plate pivotal about its one end is brought into contact with a toner carrier through the toner layer, so that a predetermined pressure can be obtained by the weight (gravity) or elasticity of the plate. In this case, in a preferred embodiment, a magnetic body is arranged behind the thin plate so that a magnetic attraction force acts on the toner carrier in addition to the contact pressure of the thin plate.

According to a preferred embodiment proposed by the present inventors, the free end side of a toner layer thickness regulating means having one end pivotal above the toner carrier extends straight in a direction opposite to the moving direction of the toner carrier. The free end is located at the upstream side of the contact position with the toner carrier. The free end and the toner carrier are separated by a very small gap.

According to another preferred embodiment, the layer thickness regulating means is made of a material which has a specific coefficient of friction which does not allow frictional charging upon contact with a flowability accelerator. These embodiments provide novel techniques and can be effectively applied to other toner layer forming apparatuses.

In the magnetic field forming means, a magnetic blade is arranged at a predetermined position on a toner carrier which opposes a fixed magnetic pole behind the toner carrier. The magnetic blade is particularly preferably arranged in a repulsive magnetic field forming region in which a pair of fixed magnets of the same polarity are arranged behind the toner carrier.

In addition to a blade of a magnetic material, the magnetic blade includes magnet blades having polarities opposite to the fixed magnetic pole at the side opposing the toner carrier.

The toner carrier is a member which magnetically conveys toner from the toner holding position to the developing position. In general, the toner carrier is a nonmagnetic sleeve or a belt including a fixed magnet assembly to be described later with reference to the embodiments of the present invention.

In the embodiments, lattice-like grooves are formed in the surface of the toner carrier which is in contact with the nonmagnetic thin plate. The grooves extend at a predetermined angle at tow sides with respect to the moving direction of the toner carrier. Even if toner having poor flowability is used or toner agglomerates, a toner layer of uniform thickness can be formed. These embodiments are novel techniques and can be applied to techniques other than the invention described above.

DETAILED DESCRIPTION OF THE PREFERRED EMBODIMENTS

The preferred embodiments of the present invention will be described below. However, the sizes, materials, shapes, relative positions of respective parts used in the embodiments are not intended to limit the scope of the present invention but are only illustrative examples, unless otherwise stated.

Figure 1:
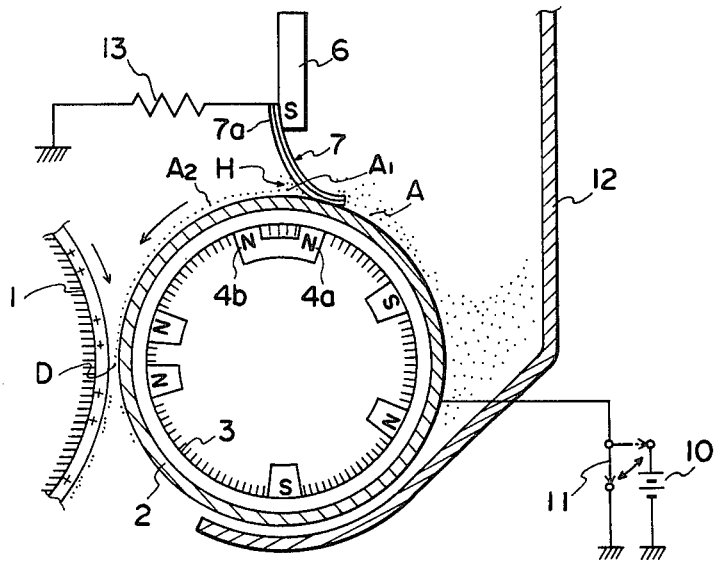
FIG. 1 is a schematic view showing a main part of a developing apparatus according to a preferred embodiment of the present invention.

FIG. 1 shows a schematic basic structure of a developing apparatus according to an embodiment of the present invention.

Reference numeral 1 denotes a photosensitive drum having a photosensitive layer; and 2, a nonmagnetic sleeve (toner carrier) having a fixed magnet assembly 3. The members 1 and 2 are arranged to oppose each other at a gap of about 200 $\mu$ at the developing position (closest position). The drum 1 rotates clockwise and the sleeve 2 rotates counterclockwise but at an equal peripheral speed, e.g., 100 rpm.

An electrostatic latent image potential of the drum 1 is 500 V in an image portion and 50 V in a nonimage portion. The latent image is formed in the photosensitive layer by a charging unit and an exposure unit (neither are shown) at the upstream side. The potential in the image portion is higher than a toner restriction potential (about 120 V; experimental value) at the sleeve 2 side and that in the nonimage portion is smaller than the toner restriction potential.

The nonmagnetic sleeve 2 is an aluminum cylinder. A rectangular DC pulse of 0 V (minimum peak) to 300 V (maximum peak) and of 1 kHz frequency is applied to the sleeve 2 by a DC power source 10 and a pulse generator 11 connected to ground. The sleeve 2 can be rotated counterclockwise to a toner deposition position on the sleeve 2 below a hopper 12. The surface shape of the sleeve 2 suitable for this embodiment will be described later.

The fixed magnet assembly 3 of the sleeve 2 has fixed magnets 4*a* and 4*b* of the same polarity. The magnets 4*a* and 4*b* are arranged at predetermined intervals therebetween on the outer circumferential surface of the sleeve 2 at the upstream side of the developing position so as to extend parallel to each other along the axial direction. The magnets 4*a* and 4*b* form a repulsive magnetic field on the sleeve 2.

In order to allow easy setting of the intervals between the magnets 4*a* and 4*b*, the opposite poles are formed integrally. The magnetic intensity of the magnets 4*a* and 4*b* is set to be such that the maximum magnetic flux density on the surface of the sleeve 2 is 600 Gauss. The interval between the magnets 4*a* and 4*b* is set such that the decrease in magnetic flux density between the magnets 4*a* and 4*b* is 100 Gauss. When this decrease in the magnetic flux density is below 100 Gauss, a sufficient repulsive magnetic field is difficult to obtain.

A magnet blade 6 is opposed to a position of the sleeve 2 between the magnets 4*a* and 4*b*. The distal or lower end of the blade 6 has a polarity opposite to the magnets 4*a* and 4*b* and is located within the repulsive magnetic field forming region at a predetermined distance from the sleeve 2. More specifically, the blade is located in the interval between the magnets 4*a* and 4*b*, the distal end is formed into a rectangular shape, and the thickness is set to be 0.3 to 2 mm. The blade 6 need not be a magnet and can be a magnetic body such as an iron body.

One end of a toner layer thickness regulating member 7 is fixed to the wall surface at the downstream side of the blade 6 along the toner convey direction. The free end side of the member 7 extends to the upstream side of the blade 6. A portion of the member 7 slightly inward from the free end and corresponding to the magnet 4*a* contacts the surface of the sleeve 2.

The regulating member 7 has a flexible and elastic nonmagnetic thin plate. The thickness of the member 7 is set to be about 100 $\mu$m or more in order to apply a predetermined contact pressure on the surface of the sleeve 2.

The regulating member 7 comprising a nonmagnetic thin plate normally consists of a nonmagnetic metal, elastic rubber, an organic resin or the like. However, when, for example, a vinyl chloride sheet is used, toner may weld onto the sheet surface upon sliding contact with a toner layer A. Therefore, the use of a vinyl chloride sheet is not preferable. In view of this, materials and other details of the member 7 which are suitable for the embodiment of the present invention will be described later.

The contact position of the regulating member 7 with the sleeve 2 must be at the upstream side of the blade 6 but can be at the upstream or downstream side of the magnet 4*a*. However, when the magnet blade 6 is too close to the sleeve 2, variations in thickness of the toner layer tend to occur by a repulsive magnetic field. On the other hand, when the magnet blade 6 is too far away from the sleeve 2, the thickness of the toner layer is disturbed before the layer reaches a repulsive magnetic field forming region H and optimal stirring of the toner may not be performed.

The operation of the apparatus according to the embodiment of the present invention will be described.

When the photosensitive drum 1 and the nonmagnetic sleeve 2 (tone carrier) rotate, a toner layer A friction-charged in the hopper 12 at the upstream side of the layer thickness regulating member 7 reaches the thickness regulating position between the sleeve 2 and the member 7 as it is carried on the sleeve 2. Thereafter, the layer A enters a contact portion between the sleeve 2 and the member 7 and its thickness is regulated to a predetermined thickness.

A toner layer A1 having a regulated thickness reaches the repulsive magnetic field forming region H upon further rotation of the sleeve 2. In the region H, restriction of the toner layer A1 on the sleeve 2 is released by the repulsive force of the magnets 4*a* and 4*b* so that it slightly floats from the sleeve 2 and is maintained in an air floating state. Toner ears A1 having a low toner particle density are subjected to thickness regulation by the magnet blade 6 and are re-arranged in a uniform and dense state on the nonmagnetic sleeve 2 by the downstream fixed magnet 4*b*. As a result, a thin and uniform toner layer A2 is formed.

According to the embodiment described above, the toner layer thickness is regulated by the contact pressure while toner is stirred at the downstream side. Therefore, even if stripes and the like are formed in the toner layer surface during thickness regulation, they can be eliminated and a uniform toner layer can be formed.

In the above embodiment, toner layer thickness regulation and toner stirring can be performed separately. Even if the toner carrier is rotated at high speed, toner layer thickness regulation and toner stirring can be performed reliably, thereby allowing formation of a uniform toner layer. In addition, since the magnet blade 6 is arranged on the nonmagnetic sleeve 2 having the thickness-regulated toner layer, the toner will not deposit on the upstream wall surface of the blade 6, so that disturbance in thickness of the toner layer is completely prevented.

In the above embodiment, toner is stirred by the magnet blade 6. In the present invention, unlike the basic conventional technique, the magnet blade 6 is not used as a toner layer thickness regulating member but is used as a member for allowing lines of magnetic force to act on the toner layer having a regulated thickness. Therefore, the gap between the toner carrier and the magnet blade 6 can be set roughly, and assembly, machining and precision adjustment are easy.

According to the embodiment, toner is stirred in the repulsive magnetic field forming region H between the magnet blade 6 and the nonmagnetic sleeve 2. Therefore, the toner layer can have a low density and can float well. Therefore, even if the nonmagnetic sleeve 2 is rotated at high speed, the toner can be stirred well and a uniform toner layer can be formed.

In the embodiment of the present invention, a space extending on the toner from the layer thickness regulating position to the toner stirring position is shielded. As a result, entrance of external floating or agglomerated toner can be prevented to allow effective toner stirring and formation of a uniform toner layer.

This embodiment will be referred to as a basic embodiment hereinafter.

If the surface of the nonmagnetic sleeve 2 is smooth in this embodiment, the surfaces of both the nonmagnetic sleeve 2 and the layer thickness regulating member 7 are both smooth. Therefore, if toner having poor flowability or agglomerated toner is used, stable layer thickness regulation cannot be performed.

This problem is common to all apparatuses of the type wherein the layer thickness is regulated by the contact pressure between the layer thickness regulating member 7 and the nonmagnetic sleeve 2. In view of this problem, conventionally, a recess is formed by blasting to form a three-dimensional surface on the nonmagnetic sleeve 2, or a groove is formed in a direction (axial direction) perpendicular to the rotating direction of the nonmagnetic sleeve 2.

However, the recess is formed in the former case and the groove is formed to extend perpendicularly to the moving direction in the latter. For this reason, toner in such a recess or groove cannot be rotated or stirred during movement and stable layer thickness regulation cannot be performed.

If a groove is formed parallel to the rotating direction of the nonmagnetic sleeve 2, toner can be rotated or stirred during movement. However, stripes tend to form.

Figure 2:
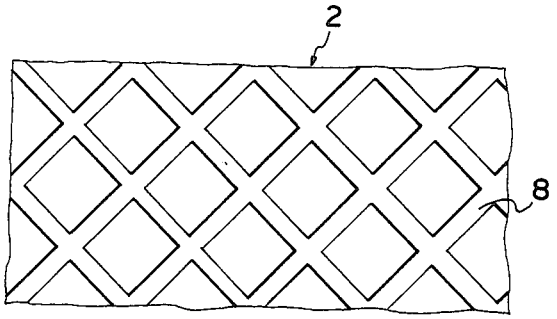
FIG. 2 is an enlarged view showing the surface shape of a toner carrier.
Figure 3:
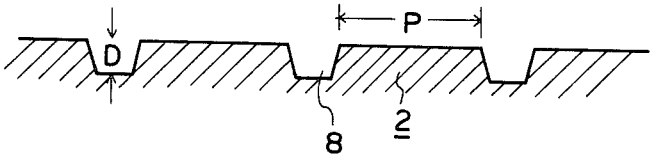
FIG. 3 is a sectional view of the toner carrier shown in FIG. 2.

FIGS. 2 and 3 show a nonmagnetic sleeve 2 with which stripes cannot be formed, toner is rotated or stirred during movement, and stable layer thickness regulation can be performed under any conditions.

As can be seen from FIGS. 2 and 3, lattice-like grooves 8 are formed in the surface of the nonmagnetic sleeve 2 at predetermined angles at two sides with respect to the rotating direction of the sleeve 2.

The angle of the grooves 8 with respect to the rotating direction of the sleeve 2 is 15 to 75° (the internal angle between adjacent grooves 8 becomes 30 to 150°) at the two sides of rotating direction and is preferably 30 to 60°. In the embodiment, this angle is set at 45°.

The lattice form of the grooves 8 is not particularly limited to a symmetrical shape and can be non-symmetrical.

A depth D of the grooves 8 is set to be $\frac{1}{4}$ to 3 times the average diameter of the toner particles, and pitch p of the adjacent grooves 8 is set to be 1 to 5 times the width of the grooves 8. The cross-section of the grooves 8 can be rectangular (FIG. 3) or semispherical.

When the depth D of the grooves 8 is less than $\frac{1}{4}$ the average diameter of the toner particles or more than 5 times thereof, the effect of the grooves 8 cannot be obtained. When the depth D of the grooves 8 is more than three times the average diameter of the toner particles, toner image formation or development is adversely affected. When the pitch p of the grooves 8 is less than the width of the grooves 8, friction occurs between the sleeve 2 and the layer thickness regulating member 7, thereby causing wear and lowering durability of the layer thickness regulating member.

In this embodiment, when the average diameter of toner particles is 10 μm, the depth D is set at 3 to 30 μm and the pitch p is set at 10 to 50 μm.

Such grooves 8 can be formed by machining process or electric or chemical process using RF treatment or etching. In the mechanical process, the surface of the sleeve 2 is brought into contact with a metal brush or a sand belt with rows of embedded needle-like cutting tools along the axial direction of the sleeve 2. The sleeve 2 is then rotated in the forward or reverse direction.

In this embodiment, when the toner layer A moves along the rotating direction of the nonmagnetic sleeve 2 on the contact surface with the layer thickness regulating member 7, since the lattice-like grooves 8 are inclined at the predetermined angle with respect to the rotating direction of the nonmagnetic sleeve 2, toner is rotated or stirred at the contact position with the layer thickness regulating member 7 while reverse flow in a direction opposite the moving direction of the sleeve 2 is prevented and formation of stripes is prevented. As a result, even if toner having poor flowability or agglomerated toner is used, a uniform toner layer can be formed.

The embodiment is not limited to the type of apparatus described above but can be applied to other types of apparatus wherein a layer thickness regulating member is brought into surface or linear contact with the nonmagnetic sleeve 2 and the thickness of the toner layer is regulated by the contact pressure between the two members.

In the basic embodiment or other embodiments described above or below, the free end of the layer thickness regulating member 7 is urged against the nonmagnetic sleeve 2 so as to regulate the thickness of the toner layer. Therefore, the layer thickness regulating member 7 may vibrate due to vibration of other external members or the like, and the contact pressure may become unstable.

Figure 4:
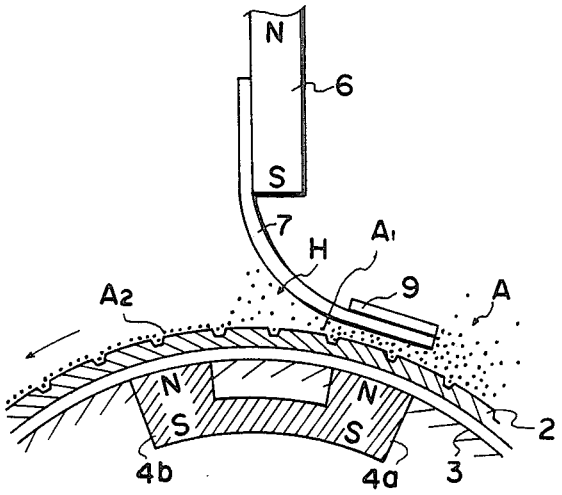
FIG. 4 is a schematic view showing a main part of a developing apparatus according to another embodiment of the present invention.

FIG. 4 is an embodiment which can solve this problem. The difference between this embodiment and the former embodiment will be described mainly. In this embodiment, the contact position at the free end of the layer thickness regulating member 7 with the surface of the nonmagnetic sleeve 2 is set to correspond to a fixed magnet 4*a*. A thin magnetic or magnet plate 9 of the opposite polarity (to that of the magnet 4*a*) is arranged on the back surface of the contact position of the layer thickness regulating member 7. Thus, a magnetic attraction force acts on the member 7 toward the sleeve 2.

As a result of the above structure, the contact pressure of the layer thickness regulating member 7 is stabilized, and vibrations in the toner layer thickness due to vibration and the like can be prevented.

When the thin magnet plate 9 of the opposite polarity is arranged, the contact position with the surface of the sleeve 2 need not correspond with the magnet 4*a* to provide a similar magnetic attraction force.

Toner used in the above embodiment is obtained in the following manner. 100 parts by weight of a polystyrene resin, 60 parts by weight of a magnetic body (ferrite), and 3 parts by weight of carbon black are mixed and solidified. The mass is crushed and sieved into particles having an average particle size of 10 to 20 μm by a hammer mill or the like. The particles are mixed with a flowability accelerator such as hydrophobic silica or the like. The obtained magnetic toner has a volume resistance of $11^{14}$ Ω·cm and 30 to 40 emu/g. In each of the embodiments described above, after the toner is charged to a predetermined polarity by friction in a hopper 12, the charged toner layer is guided to the contact position between the nonmagnetic sleeve 2 and the layer thickness regulating member 7. The thickness of the toner layer is thus regulated. During regulation of the toner layer thickness, extra charge may be introduced to adversely affect the thickness of the toner layer or charge characteristics, to cause separation of the flowability accelerator on the toner particle surfaces and subsequent decrease in toner flowability, changes over time in the charge characteristics, agglomeration in toner and formation of larger toner particles, density decrease upon development, decrease in resolution, or disturbance in image quality. The structure and material of various layer thickness regulating members which may prevent these problems will be described below.

As shown in FIG. 1 and as described above, the toner layer thickness regulating member 7 is formed as a conductive member having a predetermined elasticity to provide a predetermined contact pressure, or a laminate body including a conductive member 7*a* having a surface resistance of $10^5$ Ω/cm$^2$ or less at the contact side with the sleeve 2. More specifically, such a layer thickness regulating member 7 can be obtained by forming a metal such as copper or aluminum to a thin film having a thickness of about 100 μ or depositing such a metal thin film on a resin film such as a polyester film.

The surface potential of the member 7 at the side contacting the sleeve 2 is set substantially at the same potential as the surface potential of the sleeve 2 by grounding the conductive proximal end through a resistor 13.

According to the embodiment described above, the thickness of the charged toner layer is regulated by the toner layer thickness regulating member 7 contacting the sleeve 2. Since the side of the member 7 contacting the sleeve 2 consists of the member 7*a*, even if the thickness of the toner layer is regulated between the member 7 and the sleeve 2, the surface potential of the member 7 can be set to be substantially the same as that of the sleeve 2. As a result, the charged toner will not attach to the member 7, and toner agglomeration and formation of stripes can be prevented.

Since the conductive member 7*a* at the side contacting the toner layer is grounded, extra charge is not applied to the toner layer having a regulated thickness, so that a stable toner charge potential is maintained.

In the embodiment, a pulse voltage is applied to the sleeve 2. Therefore, while the thickness of the magnetic toner is regulated by vibration at a predetermined frequency, a more uniform toner layer can be obtained.

In order to confirm the effect of the embodiment, a development test was performed using a conductive film (Trade name: "High-beam" available from Toray Industries, Inc.) obtained by depositing aluminum on one side of a polyester film having a thickness of 100 μ, and an insulating polyester film (Trade name: "Lumilar" available from Toray Industries, Inc.) which was not subjected to aluminum deposition. With the film ("Lumilar"), toner agglomeration occurred and stripes were formed on a transfer sheet. However, with the film ("High-beam"), a stable toner layer could be obtained and no stripes were formed until toner in the hopper 12 was all consumed.

In place of a conductive member as the toner layer thickness regulating member 7 as in the above embodiment, a material having a similar coefficient of friction such that it will not cause friction charge upon contact with the flowability accelerator can be used. For example, the following materials can be used.

When hydrophobic silica having a strong negative charge is used as a flowability accelerator, it is better to use polystyrene, butadiene polychloride, natural rubber, polyethylene, polyvinyl chloride, polytetraethylene fluoride, or the like. When silica having a strong positive charge is used (e.g., silica treated with amino silane), it is better to use polyamide, melamine resin or urethane rubber. A conductive material such as carbon can be dispersed and the resultant conductive member can be used as a conductive member.

In the above embodiment, since the layer thickness regulating member consists of a material which has a coefficient of friction not causing friction with the flowability accelerator, electrostatic absorption does not occur between the toner and the regulating member. Therefore, the flowability accelerator held on the toner particles is not separated, charge and flowability characteristics of the toner do not change over time, and stable toner layer thickness regulation and excellent image formation can be performed.

Since no extra charge enters and the charge on the thickness regulating member is not increased, the toner will not attach to the regulating member and toner agglomeration and formation of stripes are prevented.

Figure 6:
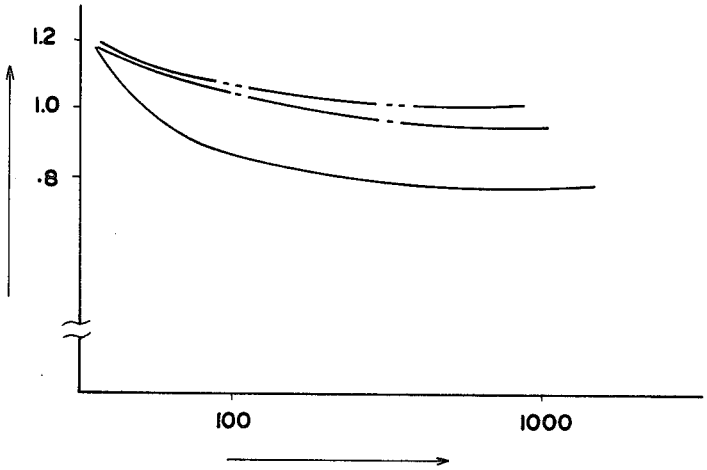
FIG. 6 is a graph showing changes in image density in the apparatus of the present invention and a conventional apparatus.
Figure 7:
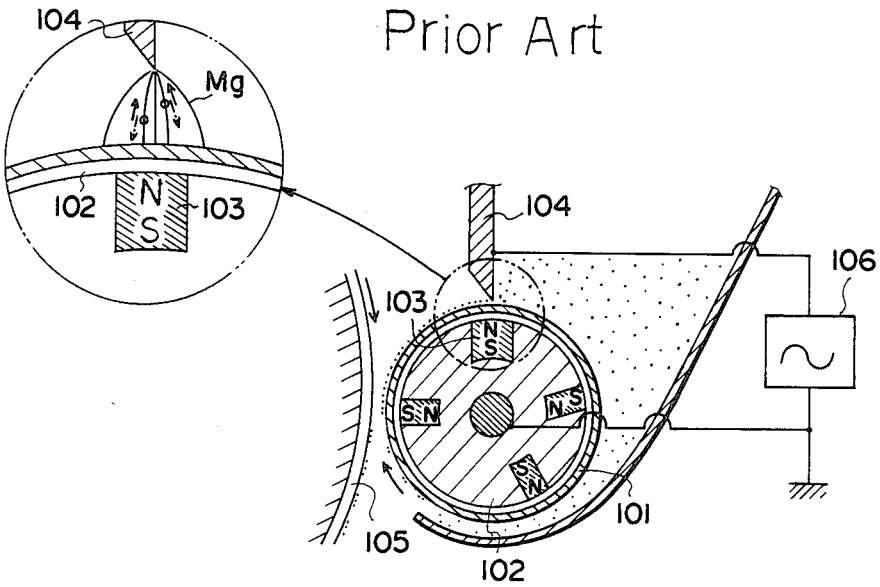
FIG. 7 Prior Art
FIG. 7 is a schematic view showing a conventional developing apparatus.

In the above embodiment, a copy test of 1,000 sheets was performed using, as the toner layer thickness regulating member 7, a film formed from a conductive vinyl chloride containing carbon (Example 1), a conductive polytetraethylene fluoride (Example 2), and a conductive silicone rubber film (Comparative Example). The obtained results are shown in FIG. 6. In the Comparative Example, the image density became 1.0 or less from 100th sheet and a considerable decrease in image density was observed. However, in either Example, the image density was 1.0 or more in 1,000th sheet.

When the images of the 100th and 1,000th sheets were examined, smearing was observed in the Comparative Example, while no smearing was observed even in the 1,000th sheets in the Examples.

The above embodiment is not limited to the basic embodiment and can be applied to other apparatuses wherein the layer thickness is regulated by the contact pressure or apparatuses using doctor blades utilizing "ear trim".

Figure 5:
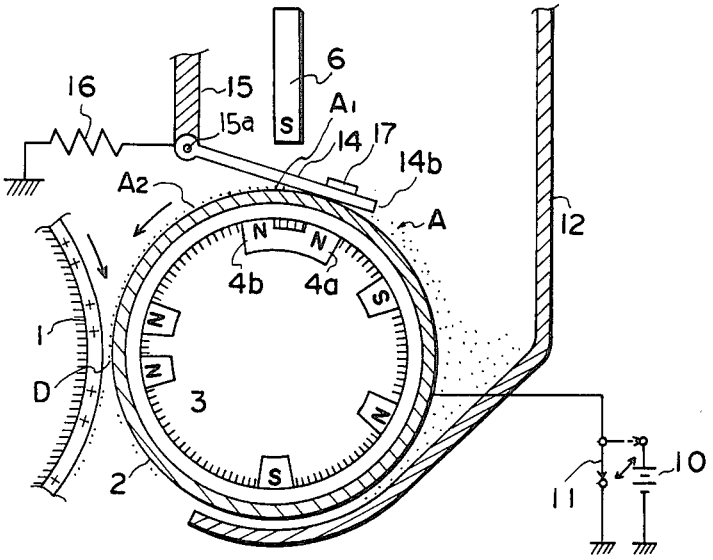
FIG. 5 is a schematic view showing a main part of a developing apparatus according to still another embodiment of the present invention.

FIG. 5 shows an embodiment using a nonmagnetic thin plate having rigidity as the layer thickness regulating member, and the same reference numerals as those in FIGS. 1 and 4 denote the same parts.

Referring to FIG. 5, a layer thickness regulating member 14 is a nonmagnetic body having a surface resistance of $10^5$ $\Omega/cm^2$ or less and consisting of a conductive material such as phosphor bronze, aluminum or a conductive resin. The member 14 has a rigidity to cause no bending when it prevents toner entrance at the side of a free end 14*b*.

One end of the member 14 is pivotally supported at a support 15 which is located at a downstream side of a magnet blade 6 along the convey direction of the toner. The member 14 extends substantially straight from a pivot point 15*a* toward the upstream side of a nonmagnetic sleeve 2. The member 14 is brought into contact with the sleeve 2 at a position corresponding to one fixed magnet 4*a* at the upstream side of the blade 6. The member 14 then extends toward the upstream side and its free end 14*b* is slightly separated from the sleeve 2.

At least the portion of the member 14 contacting the sleeve 2 comprises a conductive member. The pivot point 15*a* is grounded through a resistor 16. At the back surface of the member 14 not contacting the sleeve 2, a magnetic body or magnet 17 having the opposite polarity to that of the magnet 4*a* is arranged, so that a magnetic attraction force acts toward the sleeve 2.

The member 14 has a length and an inclination such that it extends from the downstream side of the blade 6 through the gap between the blade 6 and the sleeve 2 such that a portion before the free end 14*b* is in contact with the sleeve 2 portion corresponding to the fixed magnet 4*a*. When the total length of the member 14 from the pivot point 14*a* to the free end 14*b* is designated by L, the contact position with the sleeve 2 is set to fall within a range of $\frac{1}{3}$l from the free end 14*b*.

The operation of this embodiment will now be described.

Upon rotation of the drum 1 and the sleeve 2, the charged toner in the hopper 12 at the upstream side of the member 14 is conveyed on the sleeve 2 to a position corresponding to the free end 14*b* of the member 14. When the toner reaches the position of the free end 14*b*, its thickness is regulated to a predetermined thickness corresponding to the gap between the free end 14*b* and the sleeve 2. Then, the toner layer reaches the contact position at the upstream side.

At the contact position, the thickness of the toner layer is further regulated by the contact pressure and the magnetic attraction force of the magnetic body 17. The toner layer then reaches the repulsive magnetic field forming region opposing the magnet blade 6, in which toner is stirred, thereby forming a stable and uniform toner layer.

In this embodiment, the free end of the pivotally supported toner layer thickness regulating member is located at the upstream side of the contact position with the sleeve 2. Since the free end is slightly separated from the sleeve 2, it serves as an additional toner layer thickness regulating member. Therefore, extra toner can be returned to the back side and only a required amount of toner is brought to the contact position. Therefore, toner dragging or formation of stripes can be prevented.

In the embodiment, the regulating member does not bend and extends substantially straight toward the upstream side of the sleeve 2, in other words, in the tangential direction of the sleeve 2. Since the regulating member is pivotally supported, the contact pressure is determined by the weight of the member and the distance to the contact position.

For this reason, the contact pressure does not vary upon changes in rotational speed of the sleeve 2, the toner amount at the upstream side of the contact position, and toner layer thickness. Nonuniform thickness of the toner layer due to such variations in the contact pressure is thus prevented.

The toner layer thickness regulating member extends from the pivot point along the tangential direction of the sleeve 2. Therefore, the contact of the regulating member with the sleeve 2 is almost linear contact so that the convey pressure and friction of the toner are reduced. The amount of toner attached to the regulating member is small, and toner agglomeration and stripe formation can be prevented.

At the contact position, the toner and regulating member 14 contact with a width almost corresponding to linear contact. Therefore, the convey pressure of the toner can be minimized, and stable toner convey can be performed irrespective of the variations in the toner charge and the toner amount in the hopper. Accordingly, a toner layer having a uniform thickness and small changes over time can be stably formed.

What is claimed is:

1. An apparatus for forming a toner layer comprising toner carrier means for carrying toner and toner layer thickness regulating means comprising a nonmagnetic thin plate which contacts the toner carrier means through the toner layer, wherein a plurality of grooves are formed at both sides of said nonmagnetic thin plate in a surface of said toner carrier means contacting said nonmagnetic thin plate, so as to extend linearly in a direction inclined at predetermined angles with respect to a moving direction of said toner carrier means, and said grooves are formed in a lattice-like manner so as to intersect with each other, wherein said grooves have a depth which is $\frac{1}{4}$ to 3 times an average toner particle diameter, and a pitch of adjacent grooves is 1 to 5 times a width of said grooves.

2. An apparatus for forming a toner layer comprising toner carrier means for carrying toner and toner layer thickness regulating means comprising a nonmagnetic thin plate which contacts the toner carrier means through the toner layer, wherein a plurality of grooves are formed at both sides of said nonmagnetic thin plate in a surface of said toner carrier means contacting said nonmagnetic thin plate, so as to extend linearly in a direction inclined at predetermined angles with respect to a moving direction of said toner carrier means, and said grooves are formed in a lattice-like manner so as to intersect with each other, wherein said grooves intersect at an angle of 30° to 150°.

3. An apparatus for forming a toner layer comprising toner carrier means for carrying toner and toner layer thickness regulating means comprising a nonmagnetic thin plate which contacts the toner carrier means through the toner layer, wherein a plurality of grooves are formed at both sides of said nonmagnetic thin plate in a surface of said toner carrier means contacting said nonmagnetic thin plate, so as to be extended linearly in a direction inclined at predetermined angles with respect to a moving direction of said toner carrier means, and said grooves are formed in a lattice-like manner so as to intersect with each other, wherein said grooves have a depth which is $\frac{1}{4}$ to 3 times an average toner particle diameter, and a pitch of adjacent grooves is 1 to 5 times a width of said grooves, and further wherein said grooves intersect at an angle of 30° to 150°.

* * * * *